US010139140B2

(12) United States Patent
Zhou et al.

(10) Patent No.: US 10,139,140 B2
(45) Date of Patent: Nov. 27, 2018

(54) REFRIGERANT DISTRIBUTION DEVICE AND HEAT EXCHANGER HAVING SAME

(71) Applicant: SANHUA (HANGZHOU) MICRO CHANNEL HEAT EXCHANGER CO., LTD., Hangzhou (CN)

(72) Inventors: Jing Zhou, Hangzhou (CN); Huazhao Liu, Hangzhou (CN); Qiang Gao, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 354 days.

(21) Appl. No.: 14/910,036

(22) PCT Filed: Jan. 16, 2014

(86) PCT No.: PCT/CN2014/070737
§ 371 (c)(1),
(2) Date: Feb. 4, 2016

(87) PCT Pub. No.: WO2015/018184
PCT Pub. Date: Feb. 12, 2015

(65) Prior Publication Data

US 2016/0195315 A1 Jul. 7, 2016

(30) Foreign Application Priority Data

Aug. 6, 2013 (CN) ..... 2013 1 0340612

(51) Int. Cl.
*F28F 1/22* (2006.01)
*F25B 39/00* (2006.01)
(Continued)

(52) U.S. Cl.
CPC ..... *F25B 39/00* (2013.01); *F25B 39/028* (2013.01); *F28F 1/22* (2013.01); *F28F 9/0275* (2013.01); *F28F 13/12* (2013.01); *F28F 25/06* (2013.01)

(58) Field of Classification Search
CPC . F25B 39/00; F25B 39/028; F28F 1/22; F28F 13/12; F28F 25/06; F28F 9/22; F28F 2009/224; F28F 9/0275; F28F 9/0273
See application file for complete search history.

(56) References Cited

U.S. PATENT DOCUMENTS 9,784,505 B2 * 10/2017 Olson ..... F28D 15/046
2004/0007349 A1 1/2004 Youn et al.
(Continued)

FOREIGN PATENT DOCUMENTS

CN 1467450 A 1/2004
CN 101050899 A 10/2007
(Continued)

OTHER PUBLICATIONS

International Search Report and Written Opinion of the International Searching Authority for PCT International Application No. PCT/CN2014/070737 dated May 27, 2014.

*Primary Examiner* — Elizabeth J Martin
(74) *Attorney, Agent, or Firm* — Howard & Howard Attorneys PLLC

(57) ABSTRACT

A refrigerant distributing device and a heat exchanger having the same are provided. The refrigerant distributing device includes a distributing structure comprising a plurality of distributing pipes, at least one of the plurality of distributing pipes being provided with a distributing hole, at least two of the plurality of distributing pipes intersecting with each other; and an adapting block provided with an adapting chamber, and connected to the distributing struc-
(Continued)

ture such that the adapting chamber is communicated with an inner chamber of the distributing pipe.

18 Claims, 7 Drawing Sheets

(51) Int. Cl.

| | |
|---|---|
| ***F25B 39/02*** | (2006.01) |
| ***F28F 25/06*** | (2006.01) |
| ***F28F 9/02*** | (2006.01) |
| ***F28F 13/12*** | (2006.01) |

(56) References Cited

U.S. PATENT DOCUMENTS

| | | | |
|---|---|---|---|
| 2011/0061844 | A1 | 3/2011 | Jianlong et al. |
| 2016/0195315 | A1 | 7/2016 | Zhou et al. |

FOREIGN PATENT DOCUMENTS

| | | | |
|---|---|---|---|
| CN | 101660870 | A | 3/2010 |
| CN | 101694361 | A | 4/2010 |
| CN | 103389005 | A | 11/2013 |
| EP | 1479992 | A2 | 11/2004 |

* cited by examiner

REFRIGERANT DISTRIBUTION DEVICE AND HEAT EXCHANGER HAVING SAME

CROSS-REFERENCE TO RELATED APPLICATIONS

The present application is a National Stage of International Patent Application No. PCT/CN2014/070737 filed Jan. 16, 2014, which claims priority to and all the benefits of Chinese Patent Application No. 201310340612.0 filed Aug. 6, 2013, both of which are hereby expressly incorporated herein by reference in their entirety.

BACKGROUND OF THE INVENTION

1. Field of the Invention

The present invention relates to a refrigerant distributing device, and more particularly to a refrigerant distributing device and a heat exchanger having the same.

2. Description of the Related Art

In the field of refrigeration, a refrigerant at an inlet of an evaporator or an outdoor heat exchanger in a heat pump system is typically a gas-liquid two-phase mixture, and a gas-liquid separation phenomenon is easily formed due to a big density difference between the gas-phase refrigerant and the liquid-phase refrigerant, so that the gas-phase refrigerant is excessive within a part of flat tubes of the heat exchanger, thus forming a relatively large overheated zone, while the liquid-phase refrigerant is excessive within another part of the flat tubes of the heat exchanger, resulting in an insufficient heat exchanging and thus affecting an overall heat exchanging capability of the heat exchanger. In the related art, a distributing pipe is generally provided within a header of the heat exchanger, the refrigerant is distributed into the header from an inner chamber of the distributing pipe via a distributing hole in the distributing pipe. However, the conventional distributing pipe has an ideal refrigerant distributing effect, and thus there is a need for improvement.

SUMMARY OF THE INVENTION

Embodiments of the present invention seek to solve at least one of the problems existing in the related art to at least some extent. For this, a first objective of the present invention is to provide a refrigerant distributing device, which can reduce a gas-liquid separation phenomenon of the refrigerant, improve a distributing uniformity of the refrigerant, thereby improving a heat exchanging performance of a heat exchanger having the refrigerant distributing device.

A second objective of the present invention is to provide a heat exchanger having the above refrigerant distributing device.

A refrigerant distributing device according to embodiments of a first aspect of the present invention includes: a distributing structure includes a plurality of distributing pipes, at least one of the plurality of distributing pipes being provided with a distributing hole, at least two of the plurality of distributing pipes intersecting with each other; and an adapting block provided with an adapting chamber, and connected to the distributing structure such that the adapting chamber is communicated with an inner chamber of the distributing pipe.

With the refrigerant distributing device according to embodiments of the present invention, through the distributing structure including the plurality of distributing pipes, due to a sudden contraction of a flow section, the refrigerant ejected from the distributing hole of the at least one of the plurality of distributing pipes is injected into the heat exchanging pipe in a mist flow form in which the gas and liquid are sufficiently mixed, which strengthens a turbulence of the refrigerant after the refrigerant is ejected so as to avoids that the refrigerant, to which the gas-liquid separation phenomenon occurs, enters the heat exchanging pipe, thus achieving an objective that the refrigerant is uniformly distributed within the heat exchanging pipe and improving the heat exchanging performance of the heat exchanger.

Alternatively, the distributing pipe is configured as a capillary pipe.

In some embodiments of the present invention, the distributing pipe includes a plurality of straight pipes and a plurality of multi-way pipes.

Alternatively, the plurality of straight pipes and the plurality of multi-way pipes are connected detachably.

Specifically, the multi-way pipe includes at least one of a three-way pipe, a four-way pipe and a six-way pipe.

In some embodiments of the present invention, the distributing structure is configured as a network structure.

In an embodiment of the present invention, the distributing structure is configured as a two-dimensional network structure.

Specifically, the two-dimensional network structure includes a plurality of rectangular units.

In another embodiment of the present invention, the distributing structure is configured as a three-dimensional network structure.

Specifically, the three-dimensional network structure includes two mutually orthogonal rectangular two-dimensional network structures.

Specifically, the adapting block is further provided with a connecting hole communicated with the adapting chamber and configured to fit with the distributing pipe.

In some embodiments of the present invention, the refrigerant distributing device further includes a stopper provided with a blind hole which is configured to fit with the distributing pipe.

A heat exchanger according to embodiments of a second aspect of the present invention includes: a first header and a second header; a plurality of heat exchanging pipes, each heat exchanging pipe defining a first end connected to the first header and a second end connected to the second header; a fin disposed between two adjacent heat exchanging pipes; and a refrigerant distributing device according to embodiments of the first aspect of the present invention, disposed within at least one of the first header and the second header.

BRIEF DESCRIPTION OF THE DRAWINGS

Other advantages of the invention will be readily appreciated as the same becomes better understood by reference to the following detailed description when considered in connection with the accompanying drawings, wherein.

Figure 1:
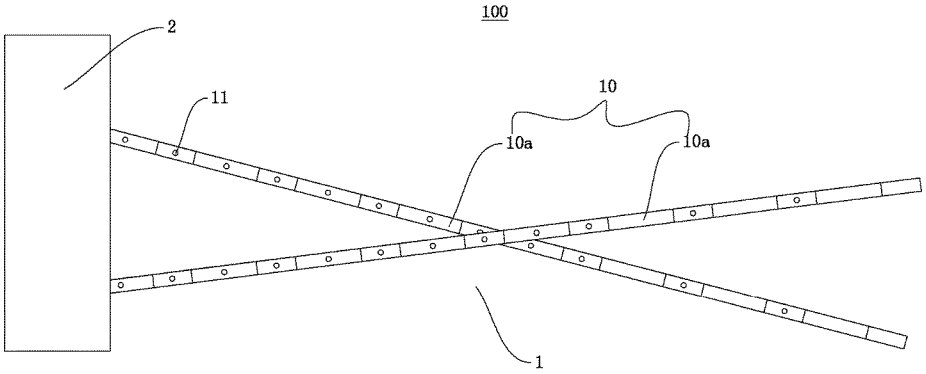
FIG. 1 is a schematic view of a refrigerant distributing device according to one embodiment of the present invention.

REFERENCE NUMERALS refrigerant distributing device 100, distributing structure 1, distributing pipe 10, straight pipe 10*a*, three-way pipe 10*b*, four-way pipe 10*c*, distributing hole 11, adapting block 2, adapting chamber 20, connecting hole 21, stopper 3, blind hole 30.

DETAILED DESCRIPTION OF THE INVENTION

Reference will be made in detail to embodiments of the present invention. Embodiments of the present invention will be shown in drawings, in which the same or similar elements and the elements having same or similar functions are denoted by like reference numerals throughout the descriptions. The embodiments described herein with reference to drawings are explanatory, illustrative, and used to generally understand the present invention. The embodiments shall not be construed to limit the present invention.

In the following, a refrigerant distributing device 100 according to embodiments of the present invention will be described in detail referring to FIG. 1 to FIG. 13. The refrigerant distributing device 100 is disposed within a header of a heat changer for distributing a refrigerant into the header.

As shown in FIG. 1 to FIG. 13, the refrigerant distributing device 100 according to embodiments of the present invention includes a distributing structure 1 and an adapting block 2. The distributing structure 1 includes a plurality of distributing pipes 10, at least one of the plurality of distributing pipes 10 is provided with a distributing hole 11, and at least one of the plurality of distributing pipes 10 intersects with at least another one of the plurality of distributing pipes 10. That is, each distributing pipe 10 may be provided with the distributing hole 11, it may also be that part of the plurality of distributing pipes 10 are provided with the distributing hole 11, while the remaining distributing pipes 10 are not provided with the distributing hole 11. At least two of the plurality of distributing pipes 10 intersect with each other. Herein, it should be understood that, the term "distributing pipe" means a pipe which has a radial dimension far less than that of the header of the heat exchanger. For example, the radial dimension of the distributing pipe is less than one fifth of that of the header of the heat exchanger, which is explanatory, illustrative, and shall not be construed to limit the present invention.

The distributing hole 11 may be configured to have any suitable shape, for example, a circular hole or a square hole, and a size of the distribution hole may be set according to a specific application. Preferably, the distributing hole 11 is configured as a slot, thus further improving a distributing effect of the refrigerant.

In some embodiments of the present invention, a position where the distributing hole 11 is located at the distributing structure 1 is corresponded to an end portion of a heat exchanging pipe of the heat exchanger when the refrigerant distributing device 100 is mounted within the header of the heat exchanger, so as to better distribute the refrigerant into the heat exchange pipe.

The adapting block 2 is provided with an adapting chamber 20 and connected to the distributing structure 1, and the adapting chamber 20 is communicated with an inner chamber of the distributing pipe 10, so as to facilitate distributing the refrigerant into the plurality of distributing pipes 10 via the adapting block 2. Moreover, the adapting block 2 may be used to fix the distributing structure 1 within the header of the heat exchanger, thereby facilitating mounting the refrigerant distributing device.

Specifically, the refrigerant firstly enters the adapting chamber 20 of the adapting block 2, then flows into the inner chamber of the distributing pipe 10 from the adapting chamber 20 and is ejected from the distributing hole 11. When the refrigerant is ejected from the distributing hole 11, as a flow section of the refrigerant is suddenly contracted, both a kinetic energy and a flow speed of the refrigerant are increased, so that the refrigerant ejected from the distributing hole 11 may enter the header in a mist flow form.

With the refrigerant distributing device 100 according to embodiments of the present invention, through the distributing structure 1 including the plurality of distributing pipes 10, in which at least one distributing pipe 10 is provided with the distributing hole 11, as the flow section of the refrigerant is suddenly contracted, the refrigerant ejected from the distributing hole 11 is ejected in the mist flow form in which the gas and liquid are sufficiently mixed, thereby avoiding that the refrigerant, to which a gas-liquid separation phenomenon occurs, enters the heat exchanger, achieving an objective that the refrigerant is uniformly distributed within the heat exchanging pipe, and improving a heat exchanging performance of the heat exchanger.

In some embodiments of the present invention, the distributing pipe 10 is configured as a capillary pipe. In other words, the distributing pipe 10 may be configured as a pipe whose inner diameter is equal to or less than 1 mm. As the flow section is suddenly contracted, both the kinetic energy and the flow speed of the refrigerant are increased, so that the refrigerant ejected from the distributing pipe 10 is ejected in the mist flow form in which the gas and liquid are sufficiently mixed, which is helpful to further improve the distributing uniformity of the refrigerant. As the distributing pipe 10 is configured as the capillary pipe, as many distributing pipes 10 as possible may be arranged within an inner chamber of the header with a limited space, so as to enhance a mixing of the gas-liquid two-phase refrigerant after the refrigerant is ejected from the capillary. At the same time, by using the capillary, the refrigerant distributing device 100 may also play a role of throttling, i.e., may be partially or even entirely undertakes a function of a throttling device. Therefore, a refrigerating system with the refrigerant distributing device 100 does not need to be provided with the throttling device additionally.

The distributing pipes 10 may be connected to form the distributing structure 1 in the manner of plugging connection, flexible connection, welding connection and gluing connection, etc.

For example, as shown in FIG. 2 to FIG. 5, the distributing pipe 10 includes a plurality of straight pipes 10*a* and a plurality of multi-way pipes. Herein, it should be understood that, the multi-way pipe refers to a pipe with three or more ways, for example, the multi-way pipe includes at least one of a three-way pipe 10*b*, a four-way pipe 10*c* and a six-way pipe. In other words, the distributing structure 1 may constituted by the plurality of straight pipes 10*a* and the plurality of multi-way pipes in connection with the plurality of straight pipes 10*a*. Preferably, the plurality of straight pipes 10*a* and the plurality of multi-way pipes are detachably connected, for example in the manner of plugging connection, flexible connection, gluing connection, etc. Certainly, the present invention shall not be limited to this, the distributing structure 1 may also be constituted by the plurality of straight pipes 10*a* connected together, and the distributing structure 1 may also be constituted by the plurality of multi-way pipes connected together.

According to some embodiments of the present invention, the distributing structure 1 is configured as a network structure, and the network structure herein should be broadly understood. In the following, the distributing structure 1 with the network structure according to different embodiments of the present invention will be described referring to FIG. 1 to FIG. 5, and it should be understood that, the network structure of the distributing structure 1 described referring to below embodiments is explanatory and illustrative.

Figure 2:
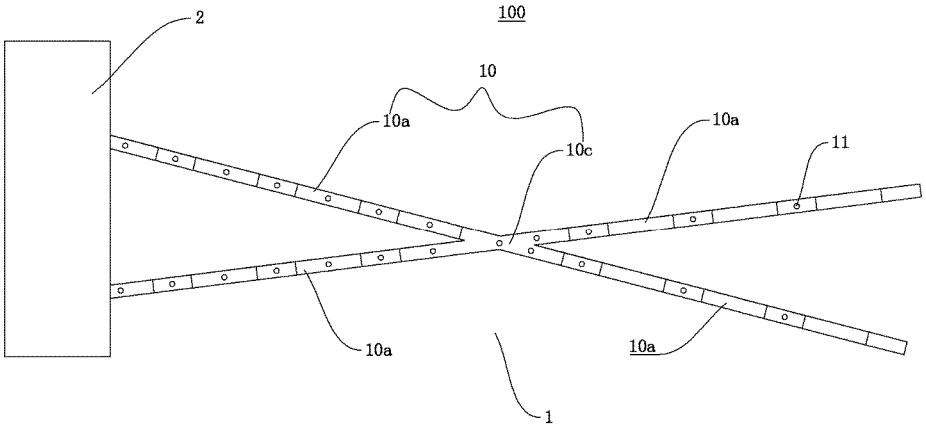
FIG. 2 is a schematic view of a refrigerant distributing device according to another embodiment of the present invention.

In an embodiment shown in FIG. 2, the distributing structure 1 is configured as a substantially X-shaped network structure, the distributing structure 1 includes the plurality of straight pipes 10*a* and one four-way pipe 10*c*, each of four pipe orifices of the four-way pipe 10*c* is respectively connected with one straight pipe section, each straight pipe section is constituted by the plurality of straight pipes 10*a* connected together, and each of two of the four straight pipe sections is connected with the adapting block 2 via one straight pipe 10*a*. That is, the distributing structure 1 includes two refrigerant flow channels communicated with each other. Preferably, the plurality of straight pipes 10*a* of each straight pipe section is provided with the distributing hole 11. Alternatively, part of the plurality of straight pipes 10*a* of each straight pipe section is provided with the distributing hole 11.

Figure 3:
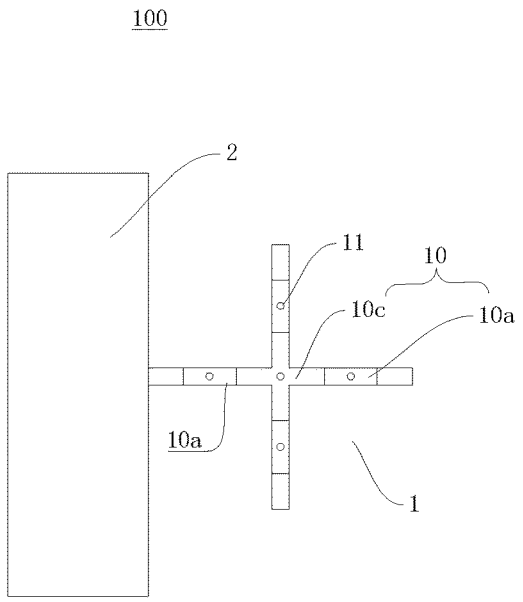
FIG. 3 is a schematic view of a refrigerant distributing device according to another embodiment of the present invention.

In an embodiment shown in FIG. 3, the distributing structure 1 is configured as a substantially cruciform network structure, the distributing structure 1 includes the plurality of straight pipes 10*a* and one four-way pipe 10*c*, each of four pipe orifices of the four-way pipe 10*c* is respectively connected with one straight pipe section, each straight pipe section is constituted by the plurality of straight pipes 10*a* connected together, and one straight pipe section of the four straight pipe sections is connected with the adapting block 2 via one straight pipe 10*a*.

Figure 4:
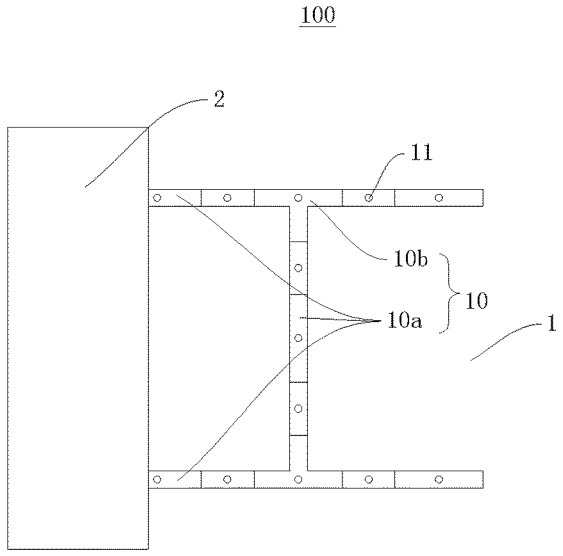
FIG. 4 is a schematic view of a refrigerant distributing device according to another embodiment of the present invention.

In an embodiment shown in FIG. 4, the distributing structure 1 is configured as a substantially I-shaped network structure, the distributing structure 1 includes two three-way pipes 10*b* and the plurality of straight pipes 10*a*, in which the two three-way pipes 10*b* are connected via the plurality of straight pipes 10*a*, and each three-way pipe 10*b* is connected with the adapting block 2 via the straight pipes 10*a*.

Figure 5:
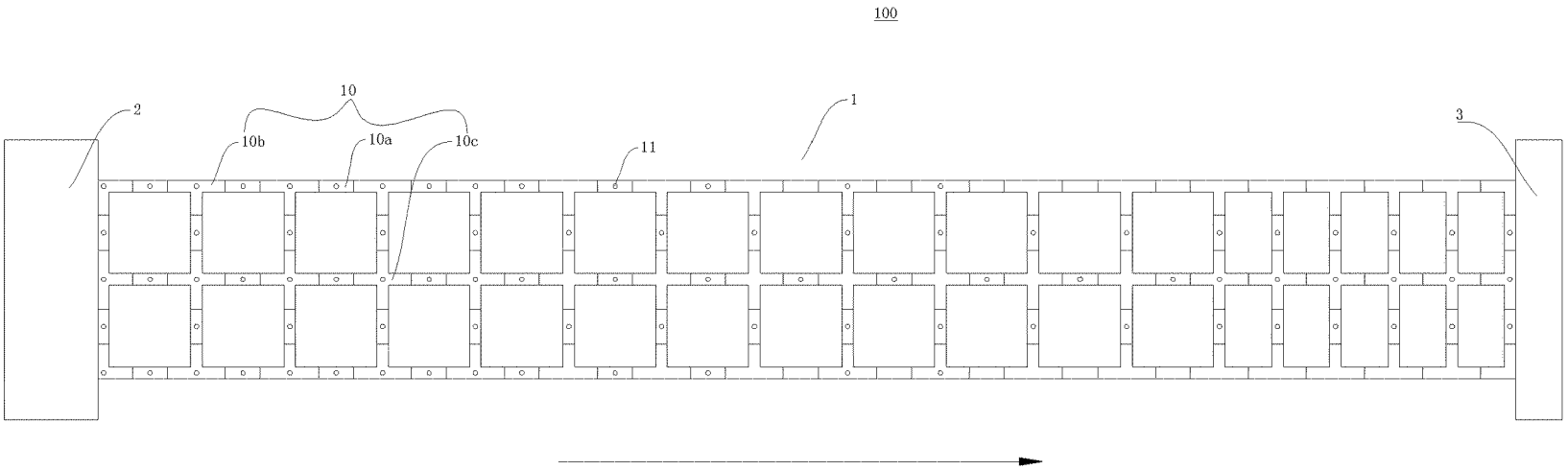
FIG. 5 is a schematic view of a refrigerant distributing device according to an embodiment of the present invention, in which a distributing structure is configured as a two-dimensional network structure.
Figure 6A:
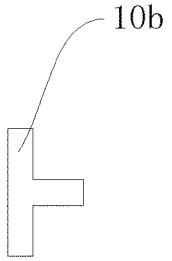
FIG. 6*a* is a schematic view illustrating the cross-sectional shape of one embodiment of the distributing pipe of the present invention.
Figure 6B:
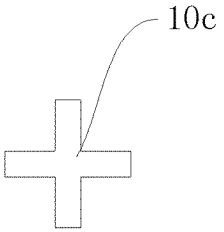
FIG. 6*b* is a schematic view illustrating the cross-sectional shape of another embodiment of the distributing pipe of the present invention.
Figure 6C:
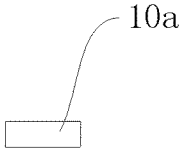
FIG. 6*c* is a schematic view illustrating the cross-sectional shape of another embodiment of the distributing pipe of the present invention.

In an embodiment shown in FIG. 5, the distributing structure 1 is configured as a two-dimensional network structure, and the two-dimensional network structure includes a plurality of rectangular units, in other words, the plurality of rectangular units are connected to form the two-dimensional network structure. More specifically, as shown in FIG. 5, each rectangular unit includes the plurality of straight pipes 10*a* and the plurality of multi-way pipes, and has the plurality of distributing holes 11. The plurality of rectangular units are arranged in multiple rows and two columns, two rectangular units in each row have equal shapes and sizes, and the rectangular units in two adjacent rows may have equal or unequal sizes. For example, in a flow direction of the refrigerant (as indicated by a arrow in FIG. 5), at a position of an end far away from the refrigerant inlet, a flux of the refrigerant is small, and a flow speed of the refrigerant is low, such that the plurality of rectangular units located at this position have small sizes and high densities, and many distributing holes 11 with large sizes are provided, so as to increase the flux of the refrigerant to balance the distribution of the refrigerant in each heat exchanging pipe.

In an embodiment shown in FIG. 1, the distributing pipe 10 includes the plurality of straight pipes 10*a*, and the plurality of straight pipes 10*a* are connected to form two straight pipe sections, i.e. each straight pipe section is constituted by the plurality of straight pipes 10*a* connected together, each straight pipe section constitutes a separate refrigerant flow channel, and the two straight pipe sections intersect with and are spaced apart from each other in space. In the plane view shown in FIG. 1, the two straight pipe sections constitute the substantially X-shaped network structure.

In some embodiments of the present invention, the distributing structure 1 may also be configured as a three-dimensional network structure. Specifically, the three-dimensional network structure may include two mutually orthogonal rectangular two-dimensional network structures which are connected via the six-way pipe.

In one embodiment of the present invention, as shown in FIG. 7 to FIG. 12, the adapting block 2 is further provided with a connecting hole 21 communicated with the adapting chamber 20 and configured to fit with the distributing pipe 10. Specifically, the connecting hole 21 is communicated with the adapting chamber 20, and the distributing pipe 10 is fitted within the connecting hole 21 to enable the inner chamber of the distributing pipe 10 to be communicated with the adapting chamber 20, so that it is convenient for the distributing pipe 10 to be connected with the adapting block 2. As shown in FIG. 5 and FIGS. 7-9, in some embodiments of the present invention, the adapting block 2 is configured to have a cylindrical shape. Preferably, a shape of a cross-section of the adapting block is matched with a shape of a cross-section of the header of the heat exchanger.

The adapting block 2 according to some embodiments of the present invention will be described below referring to FIG. 7 to FIG. 12, and the adapting block 2 in below embodiments is explanatory and illustrative.

Figure 7:
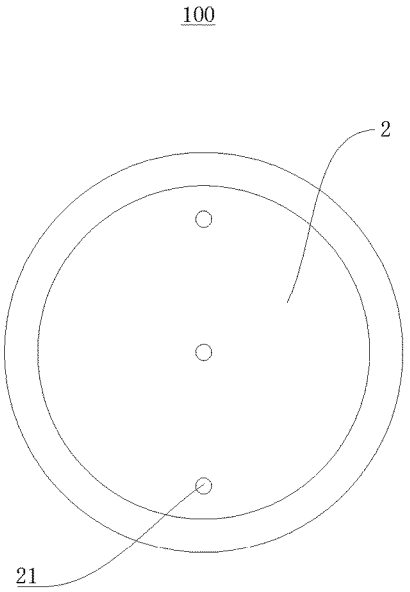
FIG. 7 is a lateral view of a refrigerant distributing device according to an embodiment of the present invention.
Figure 8:
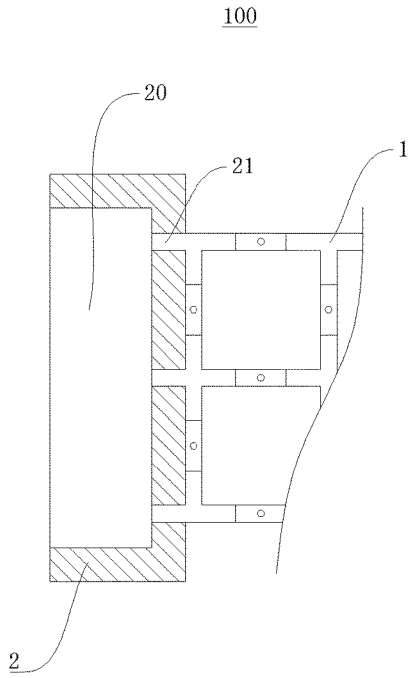
FIG. 8 is a partially cross-sectional view of a refrigerant distributing device shown in FIG. 7.

In some embodiments of the present invention, as shown in FIG. 7 and FIG. 8, the adapting block 2 has a bottom wall and an outer peripheral wall, the bottom wall and the outer peripheral wall form the adapting chamber 20 whose front end is open, and the connecting hole 21 is formed in the bottom wall and penetrates through the bottom wall in a front and rear direction (a left and right direction in FIG. 8, i.e. a flow direction of the refrigerant). The adapting block 2 has a cylindrical shape, and the adapting chamber 20 may have a circular cross-section, alternatively, may have a rectangular cross-section. The adapting block 2 is provided with three connecting holes 21 in the bottom wall thereof, and the three connecting holes 21 are spaced apart from one another and communicated with the adapting chamber 20. In embodiments shown in FIG. 7 and FIG. 8, one of the three connecting holes 21 is positioned at a center of the adapting chamber 20, and the other two connecting holes 21 are radially symmetric with respect to the center of the adapting chamber 20.

Figure 9:
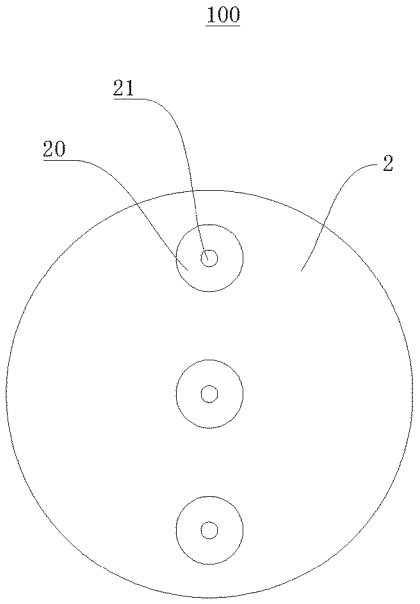
FIG. 9 is a lateral view of a refrigerant distributing device according to another embodiment of the present invention.
Figure 10:
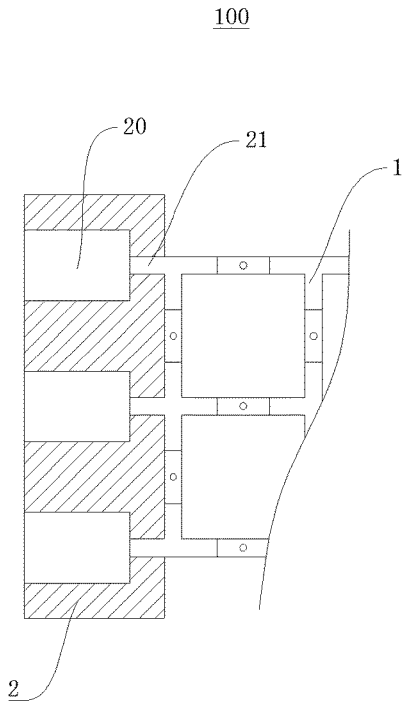
FIG. 10 is a partially cross-sectional view of a refrigerant distributing device shown in FIG. 9.

In other embodiments of the present invention, as shown in FIG. 9 and FIG. 10, the adapting block 2 is configured to have the cylindrical shape and provided with three adapting chambers 20 and three connecting holes 21, and each connecting hole 21 is communicated with a corresponding adapting chamber 20. In embodiments shown in FIG. 9 and FIG. 10, each adapting chamber 20 may have the circular cross-section, and one of the three adapting chambers 20 is positioned at a center of the adapting block 2, and the other two adapting chambers 20 are radially symmetric with respect to the center of the adapting block 2.

Figure 11:
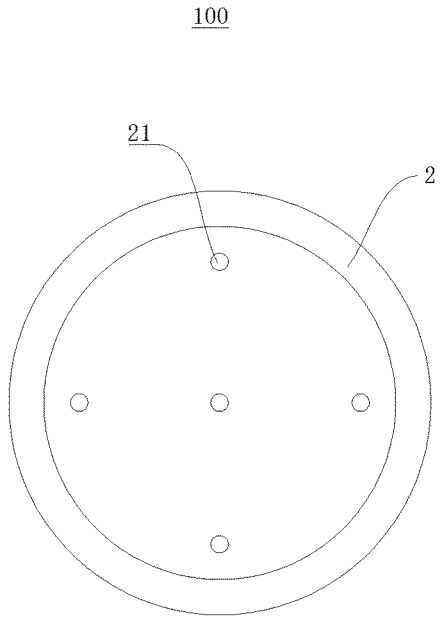
FIG. 11 is a lateral view of a refrigerant distributing device according to another embodiment of the present invention.
Figure 12:
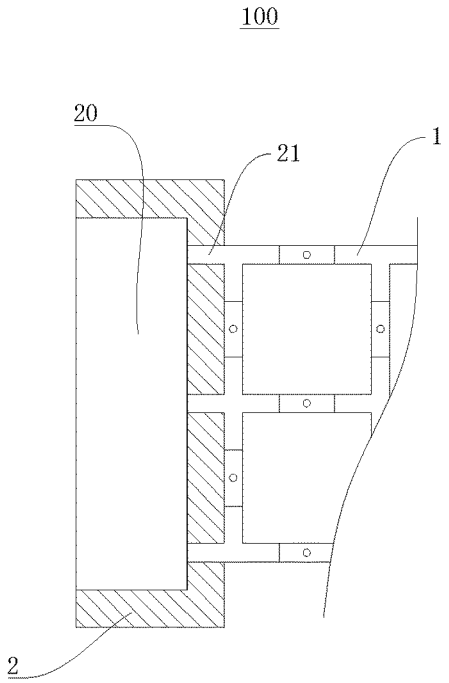
FIG. 12 is a partially cross-sectional view of a refrigerant distributing device shown in FIG. 11.

In another embodiment of the present invention, as shown in FIG. 11 and FIG. 12, the adapting block 2 is configured to have the cylindrical shape and provided with one adapting chamber 20 and five connecting holes 21, and the five connecting holes 21 are respectively communicated with the adapting chamber 20. In embodiments shown in FIG. 11 and FIG. 12, the adapting chamber 20 have the circular cross-section, one of the five connecting holes 21 is positioned at the center of the adapting chamber 20, two of the remaining four connecting holes 21 are radially symmetric with respect to the center of the adapting chamber 20 and the other two of the remaining four connecting holes 21 are radially symmetric with respect to the center of the adapting chamber 20, and the remaining four connecting holes 21 are evenly distributed at intervals in a circumferential direction.

Figure 13:
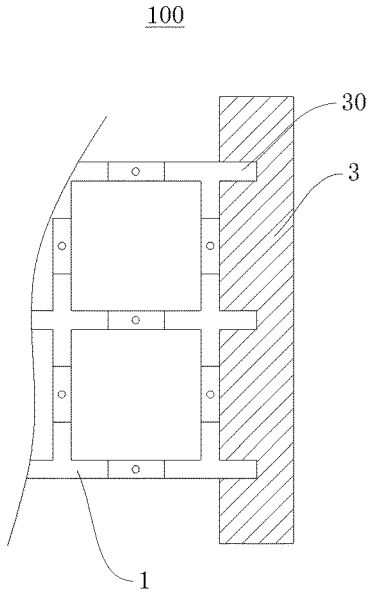
FIG. 13 is a partially cross-sectional view of a refrigerant distributing device according to an embodiment of the present invention.

In one embodiment of the present invention, as shown in FIG. 5 and FIG. 13, the refrigerant distributing device 100 further includes a stopper 3 provided with a blind hole 30 which is configured to fit with the distributing pipe 10. The stopper 3 cooperates with the adapting block 2 to fix the distributing structure 1 and blocks an outlet of the distributing structure 1. The number and distribution of the blind hole 30 may be specifically set in accordance with an actual arrangement of the distributing pipe 10. Preferably, the stopper 3 is configured to have a cylindrical shape. The stopper 3 may be used for cooperating with the adapting block 2 so as to mount the distributing device 100 within the header of the heat exchanger.

The heat exchanger according to embodiments of the present invention will be described below, which may be used in an air conditioner, a refrigerator and other refrigeration equipment.

The heat exchanger according to embodiments of the present invention includes: a first header and a second header, a plurality of heat exchanging pipes, a fin and a refrigerant distributing device. The heat exchanging pipe has a first end connected to the first header and a second end connected to the second header. Preferably, the heat exchanging pipe is configured as a flat pipe. The fin is disposed between two adjacent heat exchanging pipes. The refrigerant distributing device may be the refrigerant distributing device 100 according to above embodiments of the present invention, and is disposed within at least one of the first header and the second header. In other words, the refrigerant distributing device 100 may be disposed within only one of the first header and the second header, and may also be disposed within both the first header and the second header at the same time.

The flux and flow speed of the refrigerant may be flexibly adjusted via different assembling manners by the distributing structure 1 of the refrigerant distributing device 100 according to the structures of the heat exchanger, the first header and/or the second header and the distribution of the two-phase refrigerant, so as to achieve an objective of evenly distributing the refrigerant within each heat exchanger.

In one embodiment, the position of the distributing hole 11 in the refrigerant distributing device 100 is corresponded to the end portion position of the heat exchanging pipe, and thus it is convenient for the refrigerant in the mist flow form to directly enter the heat exchanging pipe, so as to prevent the gas-liquid separation phenomenon from occurring to the refrigerant again after the gas-liquid two-phase refrigerant flows through the distributing hole 11.

The heat exchanger of the present invention may be a parallel flow heat exchanger, and more particularly, a micro-channel heat exchanger.

Through the refrigerant distributing device 100, the heat exchanger of the present invention can prevent the gas-liquid separation phenomenon from occurring to the refrigerant, so as to improve the distributing uniformity of the refrigerant and further improve the heat exchanging performance of the heat exchanger.

In the specification, it is to be understood that terms such as "central," "length," "width," "thickness," "upper," "lower," "front," "rear," "left," "right," "vertical," "horizontal," "top," "bottom," "inner," and "outer," should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention. Many modifications and variations of the invention are possible in light of the above teachings. Therefore, within the scope of the appended claims, the invention may be practiced other than as specifically described.

What is claimed is:

1. A refrigerant distributing device, comprising:

a distributing structure comprising a plurality of distributing pipes, at least one of the plurality of distributing pipes being provided with a distributing hole, at least two of the plurality of distributing pipes intersecting with each other; and an adapting block provided with an adapting chamber, and connected to the distributing structure such that the adapting chamber is communicated with an inner chamber of the distributing pipe;

wherein the plurality of distributing pipes comprises a plurality of straight pipes and a plurality of multi-way pipes.

2. The refrigerant distributing device according to claim 1, wherein the plurality of distributing pipes is configured as capillary pipes.

3. The refrigerant distributing device according to claim 1, wherein the plurality of straight pipes and the plurality of multi-way pipes are connected detachably.

4. The refrigerant distributing device according to claim 1, wherein the plurality of multi-way pipes comprises at least one of three-way pipes, four-way pipes and six-way pipes.

5. The refrigerant distributing device according to claim 1, wherein the distributing structure is configured as a network structure.

6. The refrigerant distributing device according to claim 5, wherein the distributing structure is configured as a two-dimensional network structure.

7. The refrigerant distributing device according to claim 6, wherein the two-dimensional network structure comprises a plurality of rectangular units.

8. The refrigerant distributing device according to claim 5, wherein the distributing structure is configured as a three-dimensional network structure.

9. The refrigerant distributing device according to claim 8, wherein the three-dimensional network structure comprises two mutually orthogonal rectangular two-dimensional network structures.

10. The refrigerant distributing device according to claim 1, wherein the adapting block is further provided with a connecting hole communicated with the adapting chamber and configured to fit with the plurality of distributing pipes.

11. The refrigerant distributing device according to claim 1, further comprising a stopper provided with a blind hole which is configured to fit with the plurality of distributing pipes.

12. A heat exchanger, comprising:

a first header and a second header;

a plurality of heat exchanging pipes, each heat exchanging pipe defining a first end connected to the first header and a second end connected to the second header;

a fin disposed between two adjacent heat exchanging pipes; and a refrigerant distributing device, disposed within at least one of the first header and the second header, wherein the refrigerant distributing device includes:

a distributing structure comprising a plurality of distributing pipes, at least one of the plurality of distributing pipes being provided with a distributing hole, at least two of the plurality of distributing pipes intersecting with each other; and an adapting block provided with an adapting chamber, and connected to the distributing structure such that the adapting chamber is communicated with an inner chamber of the distributing pipe;

wherein the plurality of distributing pipes comprises a plurality of straight pipes and a plurality of multi-way pipes.

13. The heat exchanger according to claim 12, wherein the plurality of straight pipes and the plurality of multi-way pipes are connected detachably.

14. The heat exchanger according to claim 12, wherein the plurality of multi-way pipes comprises at least one of three-way pipes, four-way pipes and six-way pipes.

15. The heat exchanger according to claim 12, wherein the distributing structure is configured as a network structure.

16. The heat exchanger according to claim 15, wherein the distributing structure is configured as a two-dimensional network structure.

17. The heat exchanger according to claim 15, wherein the distributing structure is configured as a three-dimensional network structure.

18. The heat exchanger according to claim 12, wherein the adapting block is further provided with a connecting hole communicated with the adapting chamber and configured to fit with the plurality of distributing pipes.

* * * * *